US005950972A

United States Patent [19]

Irish

[11] Patent Number: 5,950,972

[45] Date of Patent: Sep. 14, 1999

[54] LADDER MOUNTED CONTAINER

[75] Inventor: Charles D. Irish, Indianapolis, Ind.

[73] Assignee: C.D.I. Enterprises, Inc., Indianapolis, Ind.

[21] Appl. No.: 08/988,141

[22] Filed: Dec. 10, 1997

Related U.S. Application Data

[60] Provisional application No. 60/034,374, Dec. 26, 1996.

[51] Int. Cl.[6] ..... E06C 7/14

[52] U.S. Cl. ..... 248/210; 182/121; 211/70.6

[58] Field of Search ..... 248/210, 238, 248/311.2; 182/121, 122, 129; 211/70.6, 86

[56] References Cited

U.S. PATENT DOCUMENTS

| | | | |
|---|---|---|---|
| 768,364 | 8/1904 | Hines | 206/372 |
| 3,269,555 | 8/1966 | Henderson | 211/126 |
| 3,642,239 | 2/1972 | Zeiler, Jr. | 248/210 |
| 3,899,045 | 8/1975 | Geisel et al. | 182/121 |
| 4,261,435 | 4/1981 | Winter | 182/129 |
| 4,310,134 | 1/1982 | Schopp et al. | 248/210 |
| 4,383,669 | 5/1983 | Rasler | 248/210 |
| 4,480,810 | 11/1984 | Hall | 248/238 |
| 4,653,713 | 3/1987 | Hamilton | 248/238 |
| 4,706,918 | 11/1987 | Wilson | 248/210 |
| 4,874,147 | 10/1989 | Ory et al. | 248/210 |
| 5,052,581 | 10/1991 | Christ et al. | 220/570 |
| 5,123,620 | 6/1992 | Bourne | 248/210 |
| 5,259,480 | 11/1993 | Bartnicki et al. | 182/173 |
| 5,333,823 | 8/1994 | Joseph | 248/146 |
| 5,342,008 | 8/1994 | Kay | 248/238 |
| 5,358,070 | 10/1994 | Bartnicki et al. | 182/173 |
| 5,370,263 | 12/1994 | Brown | 220/751 |
| 5,437,502 | 8/1995 | Warnick et al. | 312/244 |
| 5,505,302 | 4/1996 | Ferley | 206/373 |
| 5,603,405 | 2/1997 | Smith | 206/372 |
| 5,673,885 | 10/1997 | Pham | 248/210 |
| 5,782,314 | 7/1998 | Zeitler | 182/129 |

OTHER PUBLICATIONS

"Stay on your ladder with The Tool Saddle, The Ladder Mounted Tool Belt Caddy", Tool Saddle, 2 pages., Date Unknown.

"Stepladder Caddy", Ladder Man, Inc., 1 page., Date Unknown.

*Primary Examiner*—Derek J. Berger
*Assistant Examiner*—Kimberly Wood
*Attorney, Agent, or Firm*—Barnes & Thornburg

[57] ABSTRACT

A container apparatus is provided for use a top step of a ladder. The container apparatus incudes a support platform with upper and lower surfaces, a lower skirt extending from the lower surface, and a strap. The lower skirt includes front and back sides each including a mounting slot therethrough in general alignment with one another. The strap extends through the mounting slots and includes opposite ends configured to selectively fasten together.

24 Claims, 5 Drawing Sheets

LADDER MOUNTED CONTAINER

CROSS REFERENCE TO RELATED APPLICATIONS

This claims priority under 35 U.S.C. § 119(e) of Ser. No. 60/034,374 filed Dec. 26, 1996.

BACKGROUND AND SUMMARY OF THE INVENTION

The present invention relates to a container. More specifically, the present invention relates to a container suitable for use with a ladder. Most specifically, the present invention relates to a container suitable for use upon a top step of an A-frame ladder to position a variety of items in an elevated position.

Ladders enable users to attain greater vertical heights above ground when performing various tasks. For example, ladders are used by different tradesmen, such as painters, carpenters and electricians. Ladders are also widely used by homeowners. The tasks that are performed while upon ladders often require that items, such as paint cans, paint brushes, and tools be readily available. Thus, a person standing on the ladder often has a number of those items in hand. It can be cumbersome to hold a large number of items in hand or to balance those items upon the ladder itself during use.

It is known to position a carrier for tools on the top of a folding ladder. See for example U.S. Pat. No. 4,383,669, entitled "Invertible Dual Carrier for Ladder-Top Use" to Rasler. To hold such a carrier in position on the ladder, however, the container must be sized to bound the outer edge of the ladder top step. Thus, a user must keep a variety of sized carriers on hand to accommodate various sizes of ladders. The storage of additional carriers can be cumbersome, especially for tradesman who carry their equipment from project site to project site.

What is needed is a container that is configured to be fastened on differently sized ladders and that is configured to permit quick installation and removal of the container from the ladder.

According to the present invention a container apparatus is provided that is suitable for use on a top step of a ladder. The container apparatus includes a support platform that includes an upper surface and an opposite lower surface adapted to rest upon the top step in a fastened position, and a lower skirt that extends away from the surface of the support platform to define a lower cavity sized to receive the top step therein. The lower skirt includes a front side, an opposite back side, a mounting slot extending through the front side and a mounting slot extending through the back side. The mounting slots are in general alignment with one another. The container apparatus of the present invention further includes a strap sized for extension through the mounting slots. The strap includes opposite ends and a middle portion extending therebetween. The opposite ends are configured to selectively fasten together to lock the support platform upon the top step in the fastened position.

According to another embodiment of the present invention a container assembly is provided for supporting items at a selected elevation above a surface. The container assembly includes a ladder with front legs, back legs, and a top step extending between the front and back legs, and a container. The container includes a support platform adapted to rest upon the top step in a fastened position, a lower skirt that extends away from the support platform to define a lower cavity sized to receive the top step therein, and a strap. The skirt includes a front side, an opposite back side, a mounting slot extending through the front side and a mounting slot extending through the back side. The mounting slots are in general alignment with one another. The strap extends through the mounting slots. The strap includes opposite ends and a middle portion extending therebetween. In addition, the opposite ends are configured to selectively fasten together to mount the support platform upon the top step in the fastened position.

In still another embodiment of the present invention, a method for supporting items in an elevated position above a surface is provided. The method includes the steps of providing a ladder with front legs, back legs, and a top step extending between the front and back legs, the top step including a top surface and an opposite bottom surface and providing a container configured to support items thereon. The container includes a support platform adapted to rest upon the top step in a fastened position and a lower skirt that extends away from the support platform to define a lower cavity sized to receive the top step therein. The lower skirt includes a front side, an opposite back side, a mounting slot extending through the front side and a mounting slot extending through back side. The mounting slots are in general alignment with one another. The container also includes a strap that extends through the mounting slots. The strap includes opposite ends and a middle portion extending therebetween. In addition, the method includes the steps of positioning the support platform upon the top step so that the lower skirt surrounds the top step and the middle portion of the strap is situated between the support platform and the top surface of the top step and coupling the opposite ends together adjacent the bottom surface of the top step to fasten the container to the top step of the ladder so that items supported on the container are elevated above the surface upon which the ladder rests.

Additional features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
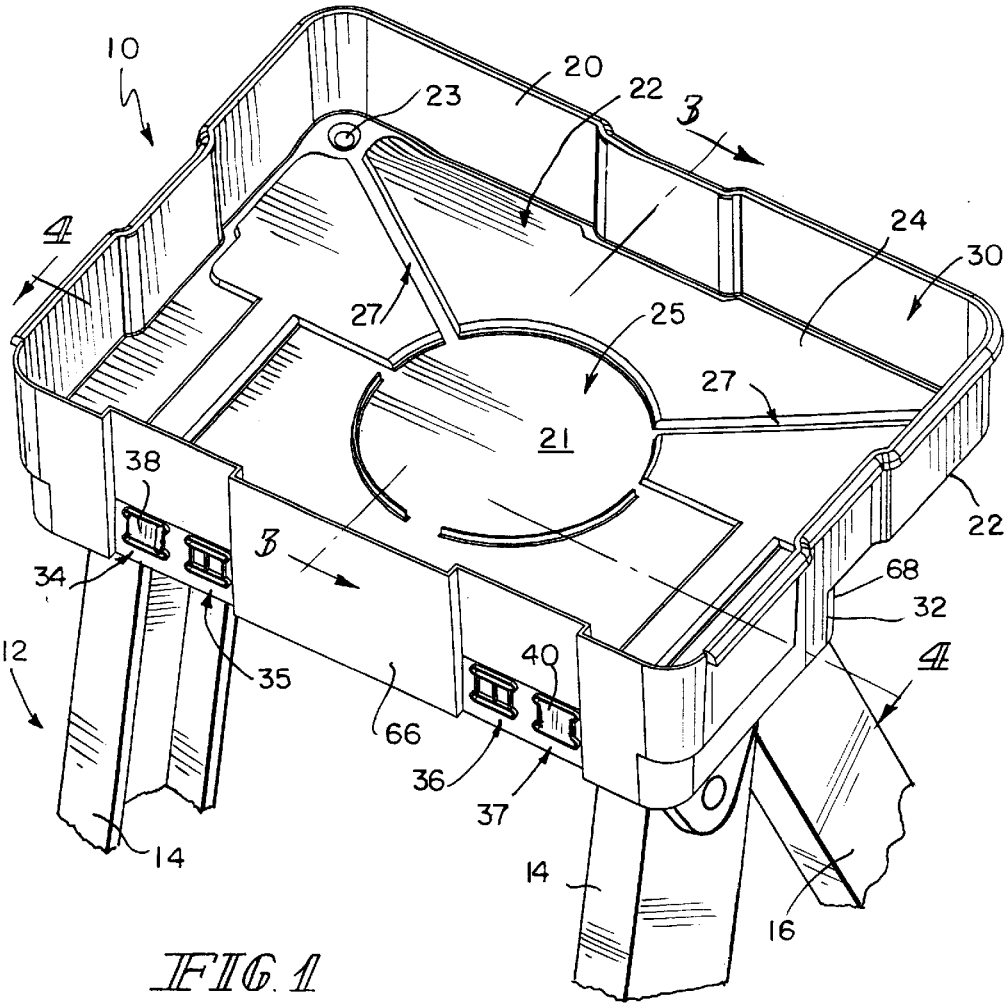
FIG. 1 is a top perspective view of a container in accordance with the present invention mounted upon a ladder and showing the container including a support platform formed to include a plurality of recesses therein, an aperture extending through the support platform, an upper skirt extending from the support platform, a lower skirt extending from the support platform away from the upper skirt, mounting slots extending through the lower skirt, and straps extending through the mounting slots to fasten the container in a fastened position upon the ladder.
Figure 3:
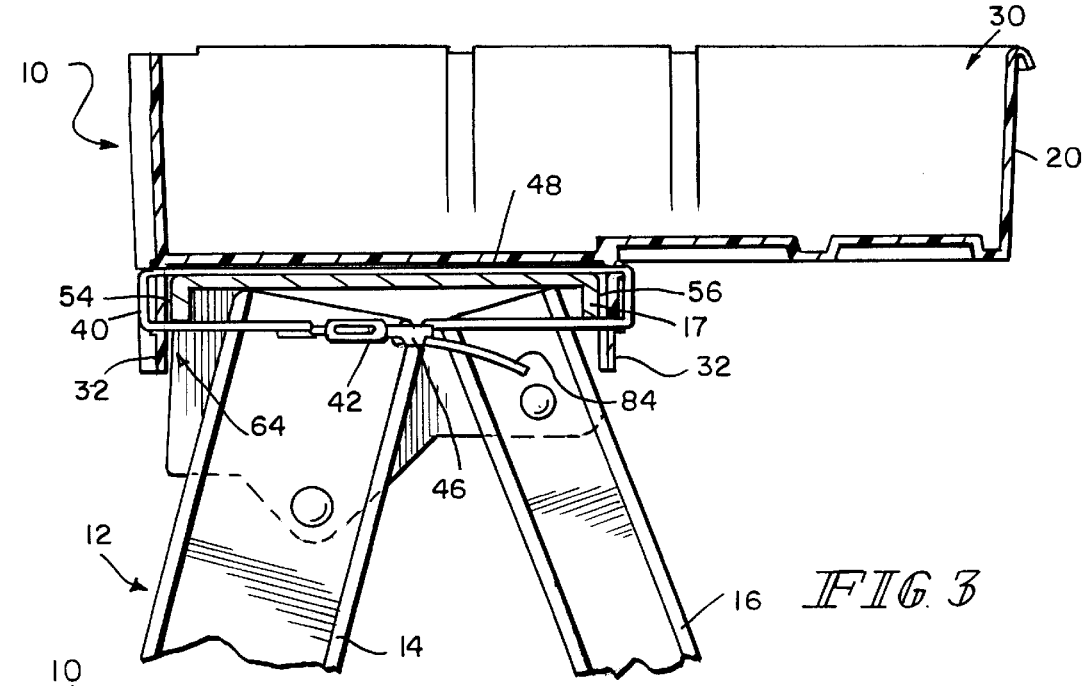
FIG. 3 is cross-sectional view taken along lines 3—3 of FIG. 1 showing the middle portion of the strap situated between the support platform and the top step of the ladder, the strap weaving through the mounting slots, and the buckle coupled to the latch to fasten the container upon the ladder.
Figure 4:
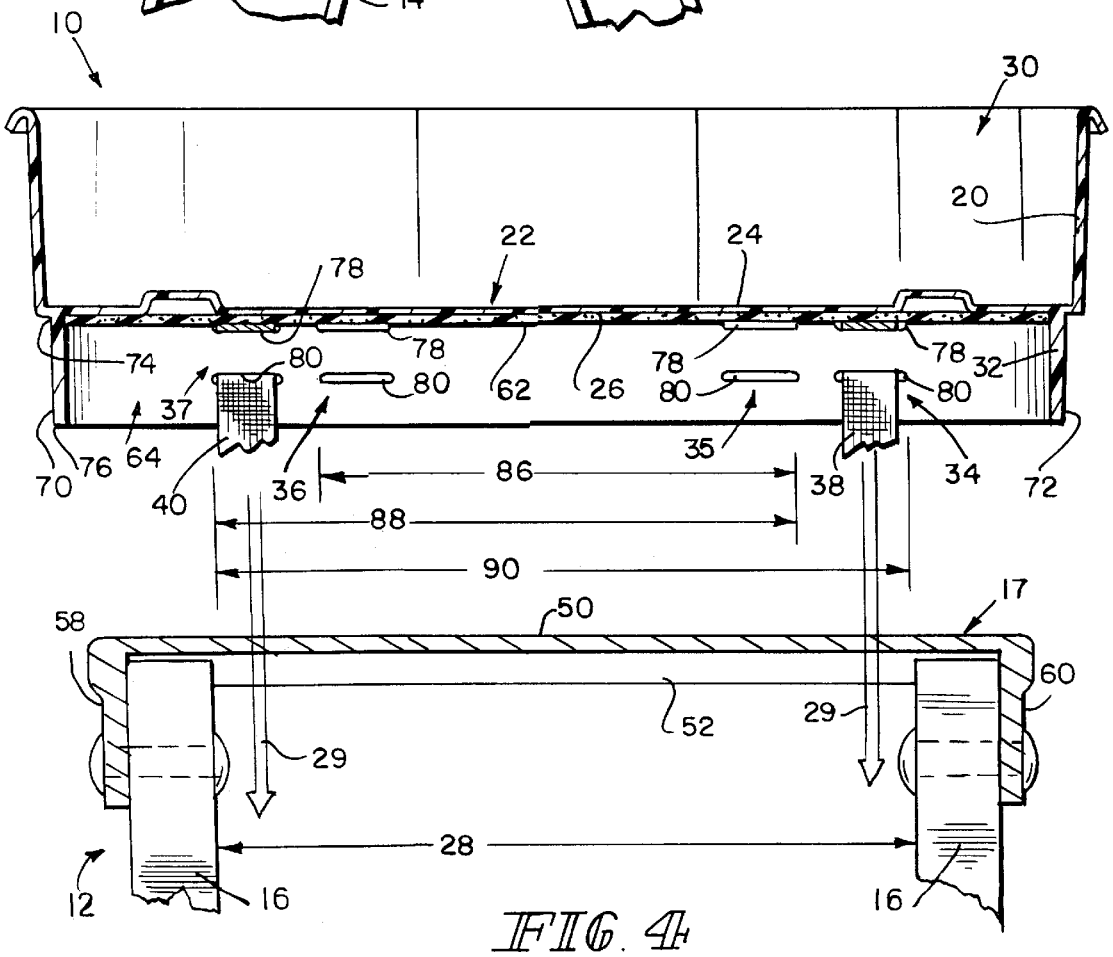
FIG. 4 is an exploded cross-sectional view taken along lines 4—4 of FIG. 1 showing the lower skirt including four sets of mounting slots spaced apart and showing relative distances between the sets of mounting slots so that the straps may be adjusted to correspond the dimensions of the top step.

As shown in FIG. 1, a container 10 in accordance with the present invention is configured to be mounted upon on a ladder 12. Container 10 supports various items, such as tools, light bulbs, paint cans, paint brushes, cleaning supplies, and the like that are often used by individuals using ladder 12. Container 10 is suited for use with ladder 12 having a pair of front legs 14, a pair of back legs 16, steps 18 (see FIG. 5) extending between front legs 14, and a top step 17 (See FIG. 3) extending between front and back legs 14, 16. As shown in FIG. 4, legs 14 are separated from one another by a distance 28. Top step 17 of ladder 12 has a top surface 50, an opposite bottom surface 52, side edges 54 56, and opposite ends 58, 60. See FIGS. 3 and 4. It is understood that ladders 12 are not uniform, and that the dimensions of top step 17 vary from one ladder to the next. Container 10 of the present invention adapts to these various dimensions and may therefore be used interchangeably with various ladders. Although one ladder 12 will be discussed hereafter, it is understood that the discussion applies to various ladders having a top step.

Referring now to FIG. 1, container 10 of the present invention includes a support platform 22, a lower skirt 32 extending from support platform 22, an upper skirt 20, and straps 38, 40 configured to fasten lower skirt 32 to top step 17 of ladder 12. Container 10 is constructed of injection molded plastic. It is understood, however, that container 10 may also be constructed from metal, wood, clay, ceramics, or other materials suitable for forming a container.

Figure 2:
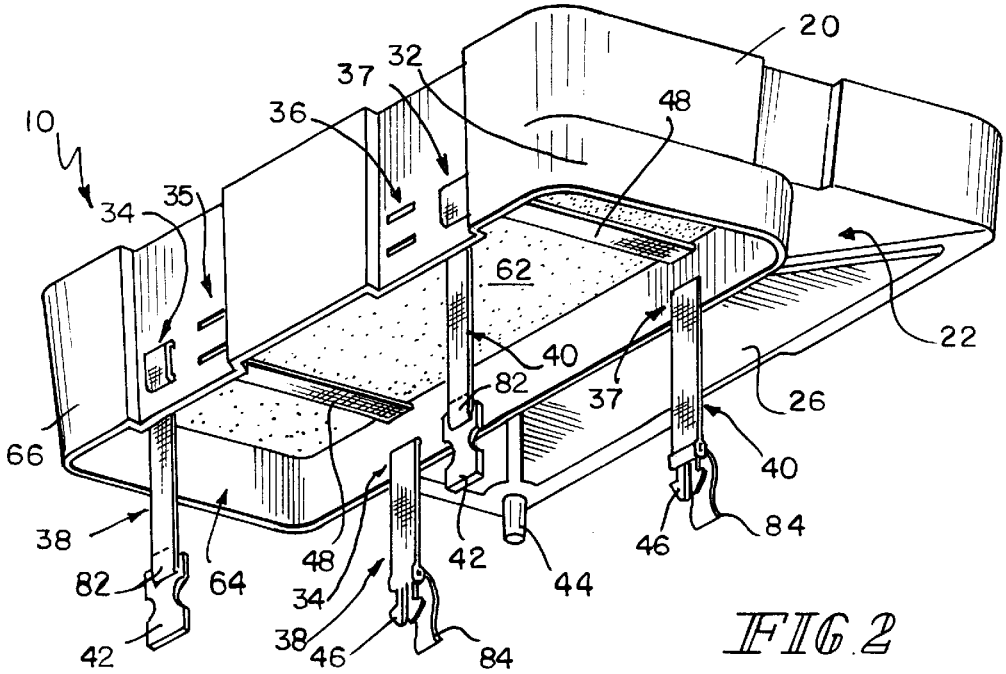
FIG. 2 is a bottom perspective view of the container of FIG. 1 showing the lower skirt including four sets of aligned mounting slots therethrough and the straps including a buckle, a latch, and a middle portion extending therebetween and showing the relative positioning of the middle portion of the strap and the support platform.

As shown in FIG. 1, support platform 22 of container 10 has an upper surface 24 and an opposite lower surface 26. Upper surface 24 of support platform 22 includes a recessed portion 21 therein. Recessed portion 21 includes a central area 25 and grooves 27 extending from central area 25. Support platform 22 also includes a drain aperture 23 extending between upper and lower surfaces 24, 26. Illustratively, grooves 27 are positioned to direct fluids toward drain aperture 23. As shown in FIG. 2, a removable plug 44 is also provided that extends into aperture 23. An anti-skid material 62, such as rubber, is adhered to lower surface 26. See FIG. 2. It is understood, that container 10 may be formed without material 26, or be formed with a wide variety of antiskid materials.

As best shown in FIGS. 2 and 4 lower skirt 32 of container 10 extends from lower surface 26 of support platform 22. Lower skirt 32 cooperates with lower surface 26 to define a lower cavity 64 therebetween that is sized to receive top step 17. Illustratively, lower skirt 32 has a first dimension and is sized for extension about top step 17 of ladder 12. See FIG. 3. Lower skirt 32 includes a front side 66, an opposite back side 68, and opposite edges 70, 72, extending between front and back sides 66, 68. See FIGS. 1 and 4. In addition, lower skirt includes a first end 74 coupled to lower surface 26 of support platform 22 and an opposite second end 76.

As best shown in FIG. 4, lower skirt 32 also includes sets of mounting slots 34, 35, 36, 37 positioned to lie adjacent opposite edges 70, 72. Each set 34, 35, 36, 37 includes a first slot 78 adjacent first end 74 and a second slot 80 adjacent second end 76. In addition, first slots 78 of each set 34, 35, 36, 37 in front side 66 are generally aligned with first slots 78 in back side 68 of lower skirt 32. Likewise, second slots 80 of each set 34, 35, 36, 37 in front side 66 are generally aligned with second slots 80 in back side 68. First and second slots 78, 80 are sized to receive straps 38, 40 therethrough. It is understood that any number of mounting slots may extend through lower skirt 32 in accordance with the present invention.

Straps 38, 40 selectively fasten lower skirt 32 and support platform 22 upon ladder 12 when container 10 is in the fastened position as shown in. FIG. 3. Referring now to FIG. 2, straps 38, 40 include opposite ends 82, 84 and a middle portion 48 extending therebetween. Middle portion 48 of straps 38, 40 extends across lower surface 26 and through first slots 78 to outside lower cavity 64. Middle portion 48 then weaves back into lower cavity 64 through second slots 80 to position opposite ends 82, 84 adjacent lower cavity 64. See FIG. 3. As used throughout the specification and claims, the term "weaves" refers the extension of straps 38, 40 in a zigzag course through lower skirt 32. Straps 38, 40 each carry a buckle 42 adjacent one end 82 and a latch 46 adjacent opposite end 84. End 84 of each strap 38, 40 is selectively movable through latch 46 to adjust the length of middle portion 48 of straps 38, 40 between latch 46 and buckle 42. Although buckle 42 and latch 46 are illustrated and described, it is understood that a wide variety of fastening mechanisms such as snaps, hook and eye-type fasteners, ties, and the like may be used with container 10 in accordance with the present invention.

Sets of mounting slots 34, 35, 36, 37 permit various combinations of strap placement through lower skirt 32. The variations in strap placement change the distance (see for example distances 86, 88, 90 in FIG. 4) between straps 38, 40 so that ladders 12 of varying sizes may be used with container 10. Specifically, strap placement may vary depending upon distance 28 between front legs 14 of ladder 12. Non-exclusive examples of strap placement options are illustrated in FIG. 4. Distance 86 spans between sets of mounting slots 35, 36. Distance 88 spans between sets of mounting slots 37, 35. It is understood that distance 88 may also represent the distance between sets 36, 34. Distance 90 spans between sets of mounting slots 34, 37. It is also within the scope of the invention that other such sets of mounting slots may be formed in lower skirt 32 of container 10 for the purpose of increasing the number of variations and combinations of strap placement available to the user. Thus, the user of container 10 may adjust the positioning of straps 38, 40 through lower skirt 32 to accommodate top steps of ladders having various sizes and therefore the user is not required to purchase a number of containers to accommodate different ladders.

In addition, container 10 includes an upper skirt 20 that extends about a circumference of support platform 22 away from upper surface 24. See FIGS. 1 and 2. Upper skirt 20 and support platform 22 cooperate to form an upper cavity 30 sized to receive items therein. Illustratively, upper skirt 20 has a second dimension that is greater than the first dimension of the lower skirt 32. See FIGS. 2 and 3. It is understood, however, that support platform 22 and upper skirt 20 of container 10 may have a variety of dimensions.

To fasten container 10 to ladder 12, straps 38, 40 are passed through predetermined sets of mounting slots 34, 35, 36, 37 formed in lower skirt 32. Any combination of sets of mounting slots 34, 35, 36, 37 may be used for receiving straps 38, 40 so long as straps 38, 40 are adjacent opposite ends 58, 60 of top step 17. As shown in FIG. 4, container 10 is then lowered in the direction of arrows 29 until container 10 assumes a fastened position on ladder 12. See FIGS. 1 and 3. At this time, middle portion 48 of straps 38, 40 is situated between lower surface 26 and top step 17. To fasten container 10 in place on top step 17 of ladder 12, buckle 42 and latch 46 are coupled together adjacent bottom surface 52 of top step 17. See FIG. 3. End 84 of straps 38, 40 may be cinched through latch 46 to lighten container 10 upon ladder 12.

Figure 5:
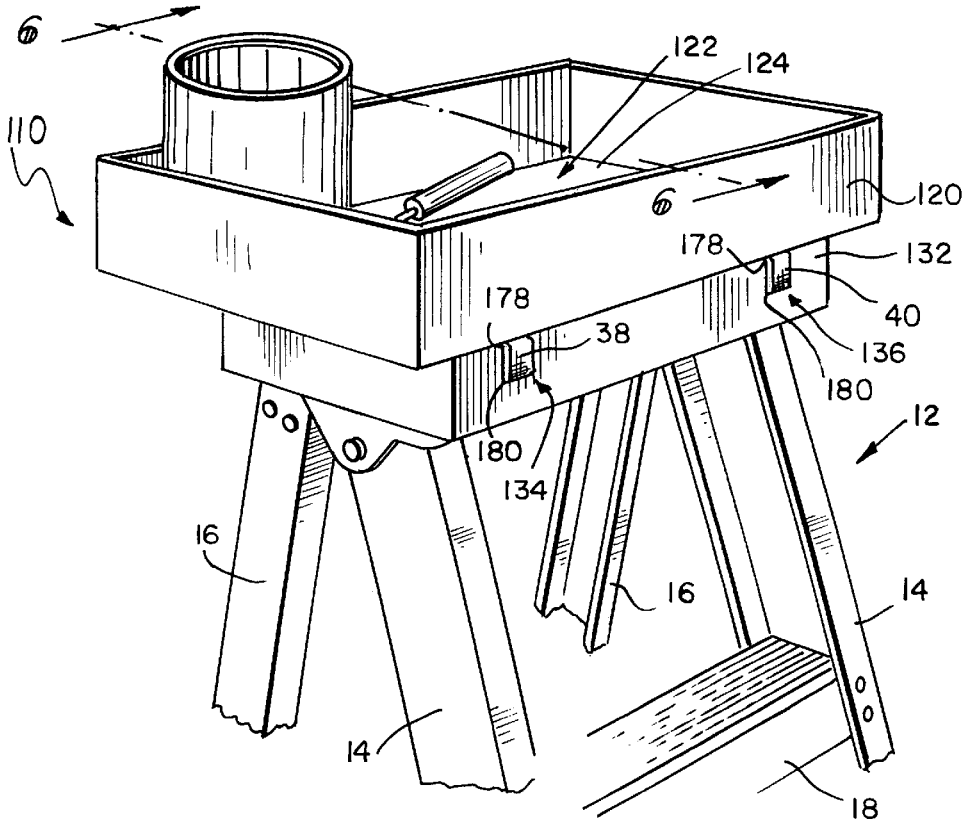
FIG. 5 is a perspective view of an alternative embodiment of the present invention showing a container including support platform, an upper skirt extending from the support platform to define an upper cavity sized to receive items therein, a lower skirt extending from the support platform away from the upper skirt, mounting slots extending through the lower skirt, and straps extending through the mounting slots to fasten the container in a fastened position upon the ladder.
Figure 6:
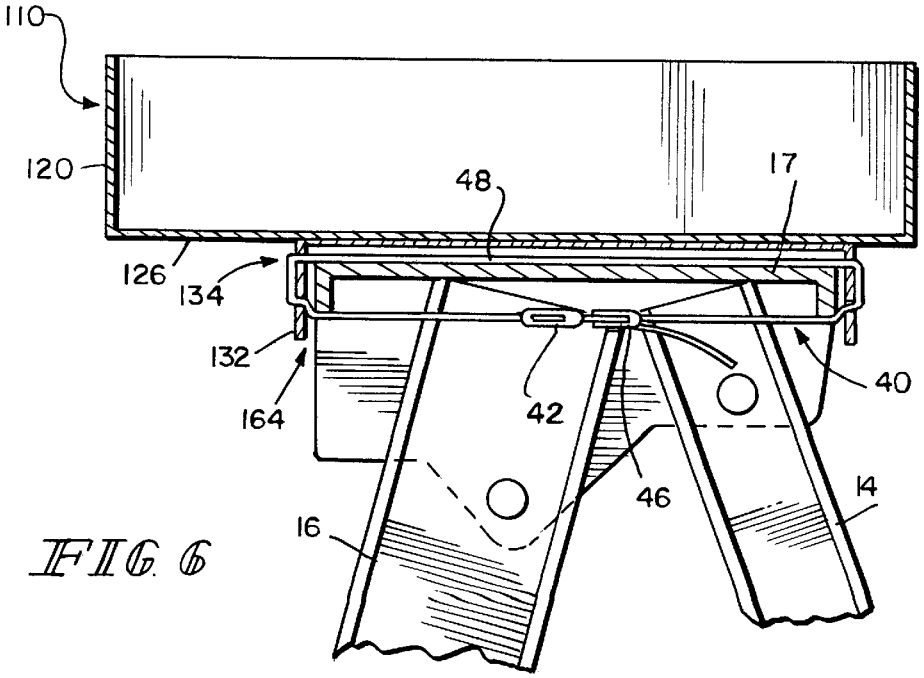
FIG. 6 is a cross-sectional view taken along line 6—6 of FIG. 5 showing the strap situated between the support platform and the top step of the ladder, the strap weaving through the mounting slots, and the buckle coupled to the latch to mount the container upon the ladder.

An alternative embodiment of the present invention is illustrated in FIGS. 5–6. A container 110 of the present invention is formed similarly to container 10 and like reference numerals will be used to denote like components. Container 110 is suited for use with ladder 12. See FIG. 5. Container 110 is constructed of metal sheeting, although it is understood that the container 110 may be constructed as previously described.

Container 110 includes a support platform 122 with an upper surface 124 and a lower surface 126. Container 110 also includes a lower skirt 132 (see FIG. 5 and 6) that extends from lower surface 126 of support platform 122 and an upper skirt 120. Lower skirt 132 and lower surface 126 define a lower cavity 164 therebetween that is sized to receive top step 17 therein. Lower skirt 132 also includes sets of mounting slots 134, 136. Each set 134, 136 includes a first slot 178 and a second slot 180. First and second slots 178, 180 are sized to receive straps 38, 40 therethrough.

Straps 38, 40 selectively couple lower skirt 132 and support platform 122 onto ladder 12 when container 10 is in the fastened position. Middle portion 48 of straps 38, 40 extends over lower surface 126 and passes through sets of mounting slots 134, 136. See, for example, FIG. 6. Container 110 is coupled to top step 17 of ladder 12 in a similar manner as container 10.

Figure 7:
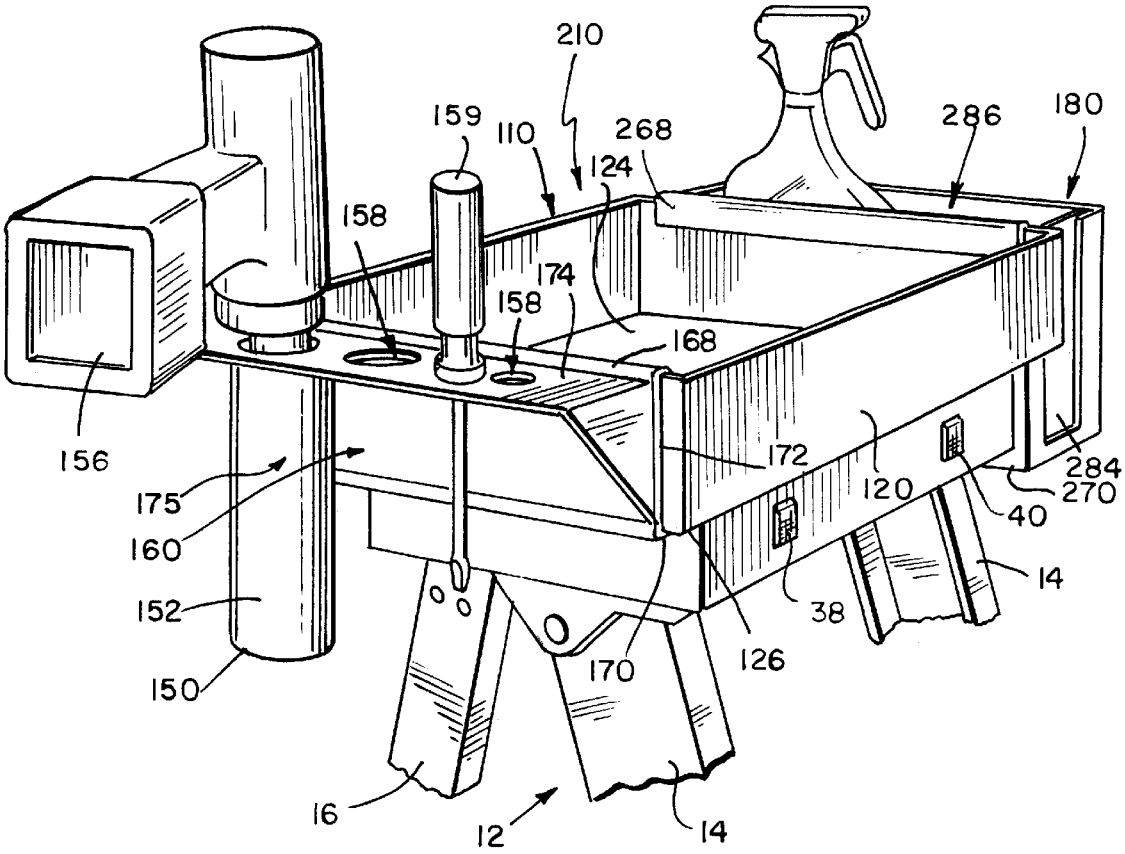
FIG. 7 is a perspective view of an alternative embodiment of the present invention showing a container including a support platform, an upper skirt extending from the support platform to define a cavity sized to receive items therein, auxiliary containers coupled to the upper skirt and extending away from the cavity, a lower skirt extending from the support platform away from the upper skirt, mounting slots extending through the lower skirt, and straps extending through the mounting slots to fasten the container in a fastened position upon the ladder.
Figure 8:
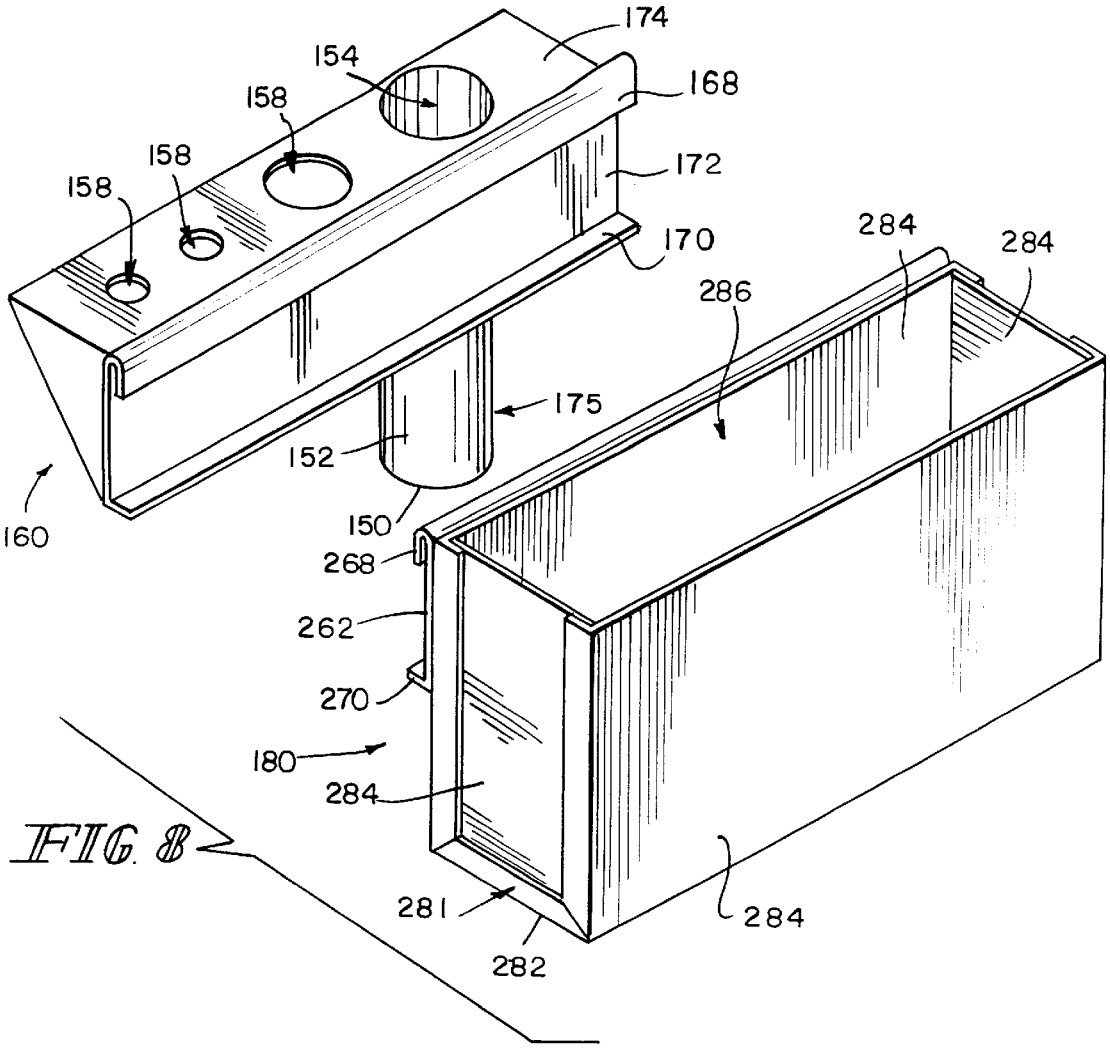
FIG. 8 is a perspective view of the auxiliary containers of FIG. 7.
Figure 9:
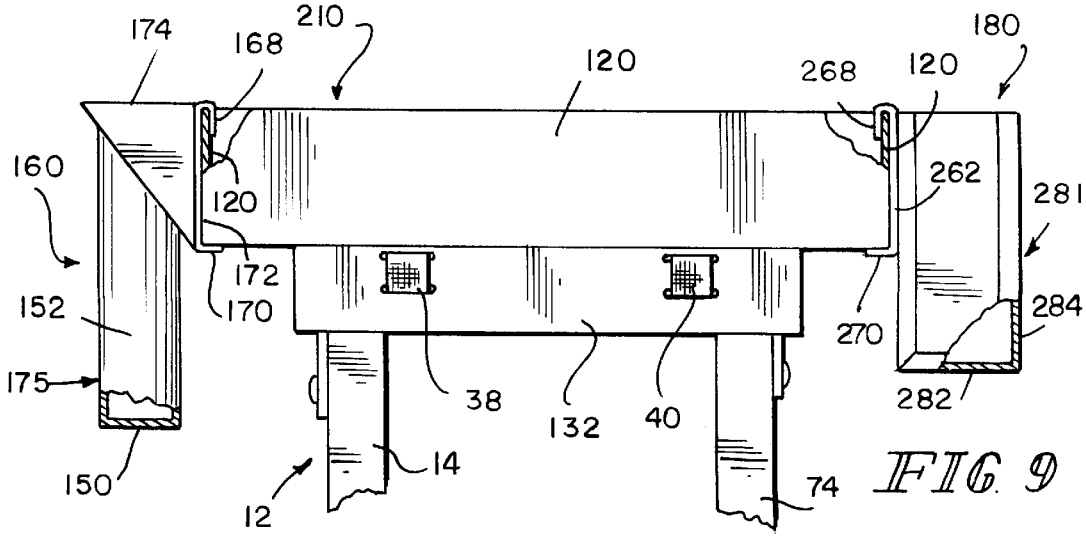
FIG. 9 is a back view with portions broken away of the container of FIG. 7 showing the auxiliary containers coupled to the upper skirt of the container.

Still another alternative embodiment of the present invention is illustrated in FIGS. 7–9. A container assembly 210 of the present invention includes container 110 and first and second auxiliary containers 160, 170 that can be selectively mounted to upper skirt 120 of container 110. See FIG. 7. First container 160 includes a lip 168, a bottom support 170, and a backplate 172 extending therebetween. Lip 168 is formed to hook over upper skirt 120 when first container 160 is coupled to container 110. Back plate 172 is formed to lie adjacent to upper skirt 120. See FIG. 7. Back plate 172 extends the full length of upper skirt 120 so that bottom support 170 rests adjacent to lower surface 126 of support platform 122. First container 160 also includes a tool-engaging surface 174 comprising tool container 175 and apertures 176 extending through surface 174. Tool container 175 includes a bottom plate 150 and a circular wall 152 extending down from surface 174 to bottom plate 150. Bottom plate 150 and circular wall 152 cooperate to form an opening 154 for holding a tool 156 such as, for example a paint gun. Apertures 158 are also provided in various different sizes and for the purpose of hanging various tools such as screwdrivers 159, etc.

Second container 180 also includes a lip 268, a bottom support 270, and a backplate 262 extending therebetween. Lip 268 is formed to hook over upper skirt 120 when second container 180 is coupled to container 110. Back plate 262 is formed to lie adjacent to upper skirt 120 that lip 268 has been hooked onto. See FIG. 8. Back plate 262 extends the full length of upper skirt 120 so that bottom support 270 rests adjacent to lower surface 126 of support platform 122. Second container 180 also includes a container 281 having a bottom wall 282 and side walls 284 extending about the circumference of bottom wall 282. Bottom wall 282 and side walls 284 cooperate to form an opening 286 sized to receive various tools and materials. Back plate 262 of second container 180 is coupled to a side wall 284.

Although the invention has been described in detail with reference to certain preferred embodiments, variations and modifications exist within the scope and spirit of the invention as described and defined in the following claims.

What is claimed is:

1. A container apparatus suitable for use on a top step of a ladder, the container apparatus comprising:

a support platform including an upper surface and an opposite lower surface adapted to rest upon the top step, a lower skirt extending away from the lower surface of the support platform to define a lower cavity, the skirt including a front side, an opposite back side, and being formed to include a mounting slot extending through the front side and a mounting slot extending through the back side and the mounting slots are in general alignment with one another, and a strap sized for extension through the mounting slots, the strap including opposite ends and a middle portion extending therebetween, and the opposite ends are configured to selectively fasten together.

2. The apparatus of claim 1, further comprising an upper skirt extending from the upper surface of the support platform to define an upper cavity therebetween.

3. The apparatus of claim 2, wherein the upper surface of the support platform is formed to include a recess extending therein.

4. The apparatus of claim 3, wherein the upper surface of the support platform is formed to include a plurality of recesses extending therein.

5. The apparatus of claim 3, wherein the support platform is formed to include an aperture extending between the upper and lower surfaces to permit drainage of fluids therethrough.

6. The apparatus of claim 2, wherein the lower skirt has a first dimension and the upper skirt has a second dimension and the first dimension is less than the second dimension.

7. The apparatus of claim 1, wherein the lower skirt includes a first end coupled to the support platform, an opposite second end, and spaced-apart mounting slots that are positioned to lie between the first and second ends.

8. The apparatus of claim 7, wherein the middle portion of the strap extends across the lower surface of the support platform between the front and back sides and weaves through the aligned mounting slots adjacent the first end of the lower skirt to outside the lower cavity and back into the lower cavity through the aligned mounting slots adjacent the second end of the lower skirt.

9. The apparatus of claim 7, wherein the lower skirt includes opposite edges extending between the front and back sides and the mounting slots are positioned to lie adjacent the opposite edges.

10. The apparatus of claim 8, wherein the one end of the strap carries a buckle and the opposite end carries a latch configured to selectively fasten to the buckle.

11. The apparatus of claim 1, wherein the one end of the strap carries a buckle and the opposite end carries a latch configured to selectively fasten to the buckle.

12. A container assembly for supporting items at a selected elevation above a surface, the container assembly comprising:

a ladder including front legs, back legs, and a top step extending between the front and back legs, and a container including a support platform adapted to rest upon the top step in a fastened position, a lower skirt extending away from the support platform to define a lower cavity sized to receive the top step therein, the skirt including a front side, an opposite back side, a mounting slots extending through the front side, and a mounting slot extending through the back side, the mounting slots being in general alignment with one another, and a strap extending through the mounting slots, the strap including opposite ends and a middle portion extending therebetween, the opposite ends being configured to selectively fasten together to mount the support platform upon the top step in the fastened position.

13. The apparatus of claim 12, wherein the lower skirt includes a first end coupled to the support platform, an opposite second end, and spaced-apart mounting slots positioned to lie between the first and second ends.

14. The apparatus of claim 13, wherein the top step includes a top surface and a bottom surface and the support platform engages the top surface and the buckle and latch are positioned to lie adjacent the bottom surface when the container is in the fastened position.

15. The apparatus of claim 14, wherein the middle portion of the strap extends between the support platform and the top step and the opposite ends of the strap are positioned to lie adjacent the bottom surface of the top step when the container is in the fastened position.

16. The apparatus of claim 12, wherein the lower skirt includes opposite edges extending between the front and back sides and the mounting slots are positioned to lie adjacent the opposite edges.

17. The apparatus of claim 16, wherein the middle portion of the strap extends between the support platform and the top step and the opposite ends of the strap are positioned to lie adjacent the bottom surface of the top step when the container is in the fastened position.

18. The assembly of claim 12, wherein the container includes an upper skirt extending from the support platform away from the lower skirt to define an upper cavity.

19. The assembly of claim 18, further comprising an auxiliary container formed for selective engagement with the upper skirt, the auxiliary container being configured to extend away from the upper skirt outside the upper cavity.

20. A method for supporting items in an elevated position above a surface, the method comprising the steps of providing a ladder including front legs, back legs, and a top step extending between the front and back legs, the top step including a top surface and an opposite bottom surface, providing a container configured to support items thereon, the container including a support platform adapted to rest upon the top step in a fastened position, a lower skirt extending away from the support platform to define a lower cavity sized to receive the top step therein, the lower skirt including a front side, an opposite back side, a mounting slot extending through the front side and a mounting slot extending through the back side, the mounting slots being in general alignment with one another, and a strap extending through the mounting slots, the strap including opposite ends and a middle portion extending therebetween, positioning the support platform upon the top step so that the lower skirt surrounds the top step and the middle portion of the strap is situated between the support platform and the top surface of the top step, and coupling the opposite ends of the strap together adjacent the bottom surface of the top step to fasten the container to the top step of the ladder so that items supported on the container are elevated above the surface upon which the ladder rests.

21. A container apparatus suitable for use on a top step of a ladder, the container apparatus comprising:

a support platform adapted to rest upon the top step, a skirt extending away from the support platform to define a cavity, the skirt including a front side, a back side, and being formed to include a mounting slot extending through the front side and a mounting slot extending through the back side, and a strap sized for extension through the mounting slots, the strap including opposite ends and a middle portion extending therebetween, and the opposite ends are configured to selectively fasten together.

22. The apparatus of claim 21, wherein the support platform is formed to include upper and lower surfaces and a drain aperture extending between the upper and lower surfaces.

23. The apparatus of claim 22, wherein the support platform is formed to include grooves formed in the upper surface.

24. The apparatus of claim 22, further comprising a plug that is sized for extension into the drain aperture.

* * * * *